US007870631B2

(12) United States Patent
Morris et al.

(10) Patent No.: US 7,870,631 B2
(45) Date of Patent: Jan. 18, 2011

(54) FOLD OUT RAMP

(75) Inventors: Donald Morris, Conifer, CO (US); David Johnson, Modesto, CA (US)

(73) Assignee: Lift-U, division of Hogan Mfg., Inc., Escalon, CA (US)

( * ) Notice: Subject to any disclaimer, the term of this patent is extended or adjusted under 35 U.S.C. 154(b) by 463 days.

(21) Appl. No.: 12/114,638

(22) Filed: May 2, 2008

(65) Prior Publication Data

US 2009/0271934 A1 Nov. 5, 2009

(51) Int. Cl.
*E01D 1/00* (2006.01)

(52) U.S. Cl. ..... 14/71.3; 14/71.1; 414/537; 414/921; 296/61

(58) Field of Classification Search ..... 14/69.5, 14/71.1, 71.3; 414/537, 921; 296/61
See application file for complete search history.

(56) References Cited

U.S. PATENT DOCUMENTS

| | | | | |
|---|---|---|---|---|
| 2,154,107 | A | 4/1939 | Nystrom | |
| 3,274,629 | A * | 9/1966 | Gearon et al. | 14/71.1 |
| 4,157,742 | A * | 6/1979 | Aanensen | 182/97 |
| 4,503,722 | A | 3/1985 | Suzuki | |
| 4,657,233 | A | 4/1987 | Vroom | |
| 5,052,521 | A | 10/1991 | Wendt | |
| 5,085,555 | A | 2/1992 | Vartanian | |
| 5,111,912 | A | 5/1992 | Kempf | |
| 5,145,310 | A | 9/1992 | Calzone | |
| 5,199,150 | A * | 4/1993 | Mortenson | 29/436 |
| 5,224,722 | A | 7/1993 | Kempf | |
| 5,253,410 | A * | 10/1993 | Mortenson | 29/436 |
| 5,287,579 | A * | 2/1994 | Estevez, Jr. | 14/71.1 |
| 5,306,113 | A | 4/1994 | Mann | |
| 5,316,432 | A | 5/1994 | Smalley | |
| 5,342,105 | A | 8/1994 | Miles | |
| 5,391,041 | A | 2/1995 | Stanbury | |

(Continued)

FOREIGN PATENT DOCUMENTS

DE 4413444 A1 10/1995

(Continued)

OTHER PUBLICATIONS

"EZ-Access Hitchhiker™ Wheelchair Ramp," EZ-ACCESS, a division of Homecare Products, Inc., n.d., <http://www.homecareproducts.com/dealers/PDF_Brochures/HitchHiker.pdf> [retrieved Oct. 20, 2008], 1 page.

(Continued)

*Primary Examiner*—Gary S Hartmann
(74) *Attorney, Agent, or Firm*—Christensen O'Connor Johnson Kindness, PLLC

(57) ABSTRACT

A ramp assembly is suitable for use with a vehicle having a floor. The ramp assembly includes a ramp rotatably coupled within the vehicle, and a moving floor having an inboard panel and an outboard panel. The outboard panel has an outboard end hingedly coupled to the inboard end of the ramp to define an outboard hinge line that moves between a raised position when the ramp is in a stowed position and a lowered position when the ramp is in a deployed position. An outboard end of the inboard panel is hingedly coupled to an inboard end of the outboard panel. A reciprocating mechanism reciprocates an inboard end of the inboard panel between a lowered position and a raised position.

20 Claims, 11 Drawing Sheets

U.S. PATENT DOCUMENTS

| | | | | |
|---|---|---|---|---|
| 5,449,267 | A | 9/1995 | Ablabutyan | |
| 5,678,984 | A | 10/1997 | Petersen | |
| 5,791,717 | A | 8/1998 | Reich | |
| 5,871,329 | A | 2/1999 | Tidrick | |
| 6,125,491 | A | 10/2000 | Alexander | |
| 6,179,545 | B1 | 1/2001 | Petersen, Jr. | |
| 6,196,609 | B1 | 3/2001 | Bowers | |
| 6,536,064 | B1 | 3/2003 | Swink | |
| 6,602,041 | B2 | 8/2003 | Lewis | |
| 6,698,998 | B2 | 3/2004 | Koretsky | |
| 6,715,177 | B1 | 4/2004 | Lagergren-Julander | |
| 6,718,886 | B2 | 4/2004 | Engle | |
| 6,802,095 | B1 * | 10/2004 | Whitmarsh et al. | 14/71.3 |
| 6,843,635 | B2 | 1/2005 | Cohn | |
| 6,860,702 | B1 | 3/2005 | Banks | |
| 6,964,445 | B1 | 11/2005 | Bellis, Jr. | |
| 6,988,289 | B2 | 1/2006 | Pedersen | |
| 7,029,050 | B1 | 4/2006 | Johnson | |
| 7,156,441 | B2 | 1/2007 | Austin | |
| 7,353,558 | B2 | 4/2008 | Alexander | |
| 7,533,432 | B2 * | 5/2009 | Morris et al. | 14/71.3 |
| 7,533,433 | B2 * | 5/2009 | Morris et al. | 14/71.3 |
| 7,533,434 | B2 * | 5/2009 | Morris et al. | 14/71.3 |
| 7,681,272 | B2 * | 3/2010 | Morris et al. | 14/71.3 |
| 2001/0048870 | A1 * | 12/2001 | Lewis et al. | 414/537 |
| 2002/0159871 | A1 | 10/2002 | Ungetheim | |
| 2002/0197141 | A1 * | 12/2002 | Cohn | 414/537 |
| 2003/0071434 | A1 | 4/2003 | Budd | |
| 2004/0022613 | A1 | 2/2004 | Kellogg | |
| 2004/0083562 | A1 | 5/2004 | Leblanc | |
| 2004/0096304 | A1 | 5/2004 | Lewis | |
| 2004/0136820 | A1 | 7/2004 | Cohn | |
| 2008/0271266 | A1 * | 11/2008 | Johnson | 14/71.1 |

FOREIGN PATENT DOCUMENTS

| | | | |
|---|---|---|---|
| DE | 202004013630 | U1 | 12/2004 |
| DE | 102004048761 | A1 | 4/2006 |
| DE | 202006012113 | U1 | 12/2006 |
| EP | 0875421 | A1 | 11/1998 |
| EP | 0976376 | B1 | 12/2001 |
| EP | 1447272 | A2 | 8/2004 |
| EP | 1738733 | B1 | 1/2007 |
| EP | 1844980 | A2 | 10/2007 |
| GB | 585917 | | 2/1947 |
| GB | 2116940 | A | 10/1983 |
| GB | 2274092 | A | 7/1994 |
| GB | 2301082 | A | 11/1996 |
| GB | 2306152 | A | 4/1997 |
| GB | 2369344 | A | 5/2002 |
| JP | 2001239888 | A | 9/2001 |
| JP | 2008230270 | A | 10/2008 |
| WO | 01/47746 | A1 | 7/2001 |
| WO | 2005/123450 | A1 | 12/2005 |

OTHER PUBLICATIONS

"Lift-U® Fold-Out Plus (LU11)," Configuration Drawing, Hogan Mfg., Inc., n.d., <http://liftu.hoganmfg.com/resources/docs/products/lu-11/32inWide_X_12inRise_Rev A.pdf> [retrieved Oct. 20, 2008], 4 pages.

"Lift-U® Fold-Out Plus (LU11)," Product Brochure, Hogan Mfg., Inc., n.d., <http://liftu.hoganmfg.com/resources/docs/products/lu-11/LU11_Brochure_080924.pdf> [retrieved Oct. 20, 2008], 2 pages.

"Powerleaf," Deans Systems, n.d., <http://doorsystemsgroup.net/index.php?option=com_content&view=article&id=58&Itemid=84> [retrieved Oct. 20, 2008], 1 page.

"Products: Transit/Motorcoach," Ricon Corp. © 2007, <http://www.riconcorp.com/pdfs/ricon_ramps.pdf> [retrieved Oct. 20, 2008], 2 pages.

"RA400 Transit Ramp," The Braun Corporation, n.d., <http://www.braunmobility.com/products/commlif/media/RA400.pdf> [retrieved Oct. 20, 2008], 2 pages.

* cited by examiner

FOLD OUT RAMP

FIELD OF THE INVENTION

The present invention relates generally to wheelchair lifts and, more particularly, to a fold out ramp for a vehicle.

BACKGROUND OF THE INVENTION

The Americans with Disabilities Act (ADA) requires the removal of physical obstacles to those who are physically challenged. The stated objective of this legislation has increased public awareness and concern over the requirements of the physically challenged. Consequentially, there has been more emphasis on providing systems that enable physically challenged people to access a motor vehicle, such as a bus or minivan.

A common manner of providing the physically challenged with access to motor vehicles is a ramp. Various ramp operating systems for motor vehicles are known in the art. Some slide out from underneath the floor of the vehicle and tilt down. Others are stowed in a vertical position and pivot about a hinge, while still others are supported by booms and cable assemblies. The present invention is generally directed to a "fold out" type of ramp. Such a ramp is normally stowed in a horizontal position within a recess in the vehicle floor, and is pivoted upward and outward to a downward-sloping extended position. In the extended position, the ramp is adjustable to varying curb heights.

Fold out ramps on vehicles confront a variety of technical problems. Longer ramps are desirable because the resulting slope is more gradual and more accessible by wheelchair-bound passengers. Longer ramps are, however, heavier and require more torque about the pivot axis to be reciprocated between deployed and stowed positions. To satisfy the increased torque requirement, such fold out ramps use large electric motors, pneumatic devices, or hydraulic actuators to deploy and stow the ramp. Many of such systems cannot be moved manually in the event of failure of the power source unless the drive mechanism is first disengaged. Some existing fold out ramps can be deployed or stowed manually, but they are difficult to operate because one must first overcome the resistance of the drive mechanism. Further, fold out ramps require a depression (or pocket) in the vehicle's vestibule floor in which to store the retracted/stowed ramp. When the ramp is deployed, the aforementioned depression presents an obstacle for wheelchair passengers as they transition from the ramp to the vestibule, and into the vehicle.

As noted above, many existing fold out ramps are equipped with hydraulic, electric, or pneumatic actuating devices. Such devices are obtrusive and make access to and from a vehicle difficult when the ramp is stowed. Moreover, many of such fold out ramps have no energy storage capabilities to aid the lifting of the ramp, which would preserve the life of the drive motor or even allow a smaller drive to be employed. Finally, operating systems for such fold out ramps must have large power sources to overcome the moment placed on the hinge by the necessarily long moment arm of the fold out ramp.

In view of the foregoing, there is a need for a fold out ramp for a vehicle that provides a longer ramp surface to reduce the ramp angle, and comprises an interior surface coplanar with the adjacent vehicle floor, and further includes a compact and efficient operating system.

SUMMARY

An exemplary embodiment of a disclosed ramp assembly is suitable for use with a vehicle with a floor. The ramp assembly includes a ramp rotatably coupled within the vehicle. The ramp assembly further includes a moving floor having an inboard panel and an outboard panel. The outboard panel has an outboard end hingedly coupled to the inboard end of the ramp to define an outboard hinge line, which moves between a raised position when the ramp is in the stowed position, and a lowered position when the ramp is in the deployed position. The inboard panel has an outboard end hingedly coupled to an inboard end of the outboard panel. A reciprocating mechanism reciprocates an inboard end of the inboard panel between a lowered position when the ramp is in the stowed position, and a raised position when the ramp is in the deployed position.

A second embodiment of a disclosed wheelchair ramp assembly is suitable for use with a vehicle with a floor. The ramp assembly includes a ramp coupled within the vehicle. The ramp assembly further includes an outboard panel having an outboard end hingedly coupled to the inboard end of the ramp to define a hinge line, and an inboard panel having an outboard end hingedly coupled to an inboard end of the outboard panel. A reciprocating mechanism reciprocates an inboard end of the inboard panel between a lowered position when the ramp is in the stowed position, and a raised position when the ramp is in the deployed position. A support member supports an inboard portion of the outboard panel.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Exemplary embodiments of the disclosed fold out ramp will now be described with reference to the accompanying drawings where like numerals correspond to like elements. The described embodiments are directed to ramp assemblies, and more specifically, wheelchair ramp assemblies. In particular, several embodiments are directed to wheelchair ramp assemblies suitable for use in buses, vans, etc. Several embodiments of the present invention are directed to compact ramp assemblies for a vehicle that, when stowed, occupy a small amount of space within the vehicle floor, yet deploy to a length that effectively reduces the ramp slope encountered by the mobility impaired, thus facilitating greater independence and safety for wheelchair-bound passengers.

The following discussion proceeds with reference to examples of wheelchair ramp assemblies for use in vehicles having a floor, such as a bus, van, etc. While the examples provided herein have been described with reference to their association with vehicles, it will be apparent to one skilled in the art that this is done for illustrative purposes and should not be construed as limiting the scope of the disclosed subject matter, as claimed. Thus, it will be apparent to one skilled in the art that aspects of the disclosed fold out ramp may be employed with other ramp assemblies used in stationary installations, such as residential buildings and the like. The following detailed description may use illustrative terms such as vertical, horizontal, front, rear, inboard, outboard, proximal, distal, etc.; however, these terms are descriptive in nature and should not be construed as limiting. Further, it will be appreciated that various embodiments of the disclosed fold out ramp may employ any combination of features described herein.

Fold Out Ramp Assembly

Figure 1:
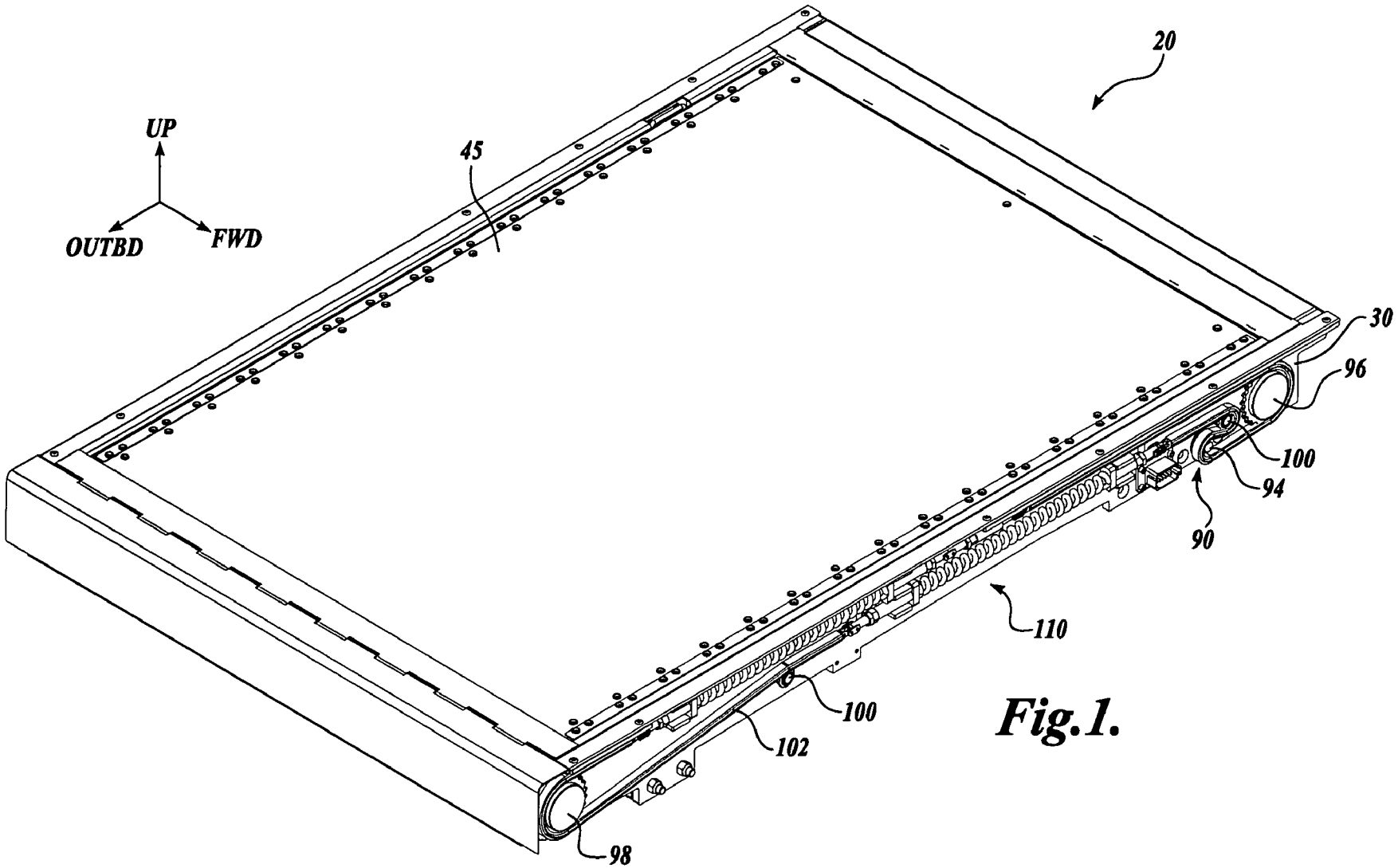
FIG. 1 is an isometric view of an exemplary embodiment of a ramp assembly with an outboard ramp in the stowed position.
Figure 2:
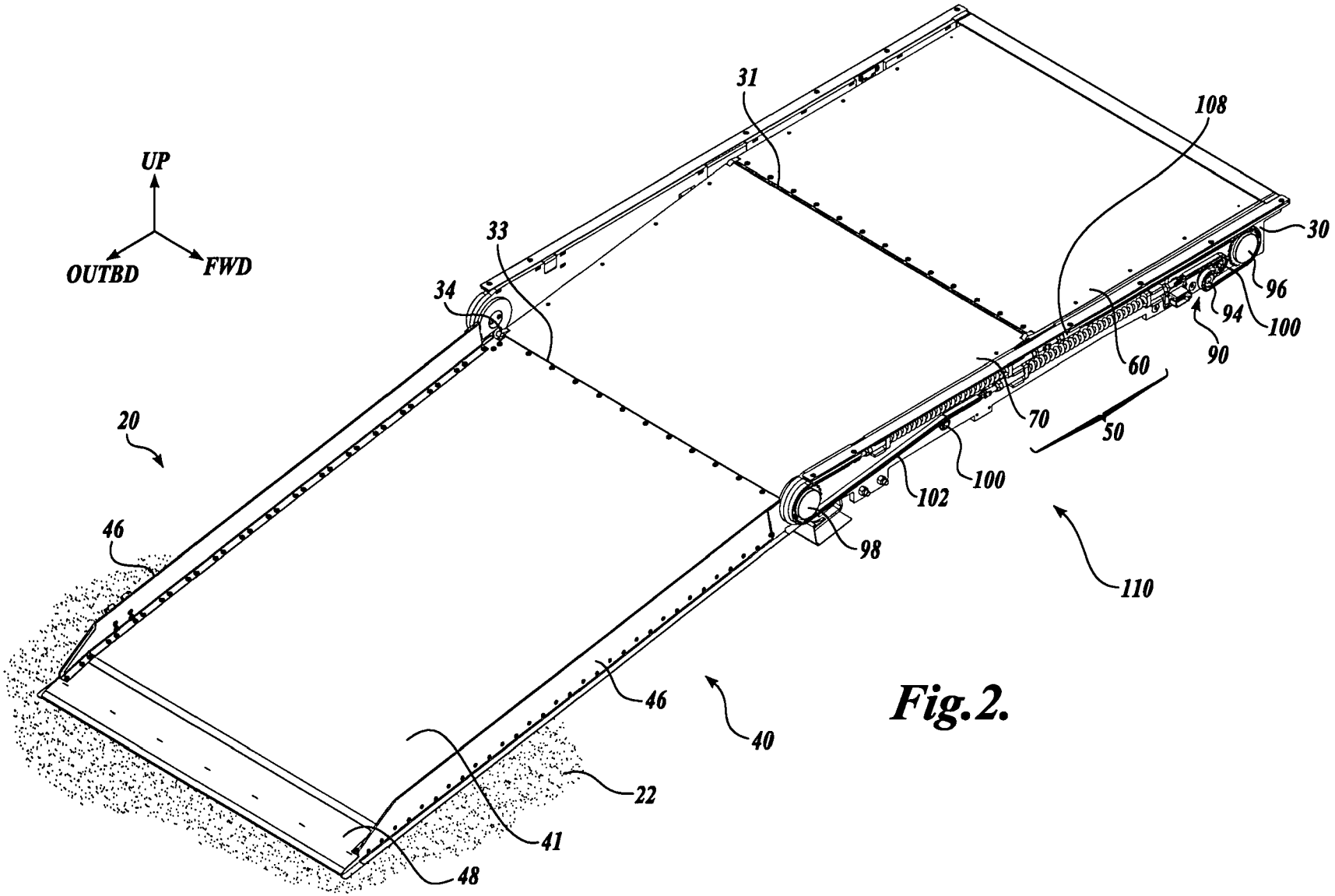
FIG. 2 is an isometric view of the ramp assembly shown in FIG. 1, with the outboard ramp in a deployed position.

FIGS. 1 and 2 illustrate one embodiment of a fold out ramp assembly 20 (hereinafter "ramp assembly 20"). The ramp assembly 20 includes a frame 30, a drive assembly 90, an outboard ramp 40, a moving floor 50, and a counterbalance assembly 110. The frame 30 of the ramp assembly 20 is adapted to be mounted to a vehicle (not shown) having a floor, such as a bus or a van. The ramp assembly 20 is reciprocal between the stowed position, shown in FIG. 1, and a deployed position, shown in FIG. 2. In the stowed position, the outboard ramp 40 and moving floor 50 are located such that the outboard ramp 40 is positioned over the moving floor 50, and the lower surface 45 of the outboard ramp 40 faces upward and is substantially coplanar, i.e., flush, with the floor (not shown) of the vehicle. In a deployed position, the outboard ramp 40 extends in an outboard and downward direction to contact a surface 22, such as a curb or road side, thus providing a transition between the vehicle and the surface 22.

Although the illustrated embodiments of the ramp assembly 20 include a frame 30, other embodiments are contemplated in which the ramp assembly 20 does not include a frame 30. When such embodiments are installed in vehicles, the ramp assembly 20 components are attached directly to the structure of the vehicle or to a suitable structure within the vehicle, thus making a frame 30 unnecessary. Similarly, when such embodiments are installed in stationary installations, such as residential buildings and the like, the ramp assembly 20 components are attached to the structure of the building or any other suitable structure within the building. Accordingly, embodiments of the described ramp assembly 20 that do not include a frame, should be considered within the scope of the present disclosure.

Referring to FIG. 2, the outboard ramp 40 is pivotally connected to the frame 30 and hingedly coupled to the moving floor 50. The outboard ramp 40 includes a panel 41, which is constructed from well-known materials. The outboard ramp 40 further includes side curbs 46 that extend upwardly from the forward and rear sides of the panel 41. The side curbs 46 increase the strength of the outboard ramp 40 and provide edge guards for the sides of the outboard ramp 40, thereby increasing the overall safety of the ramp assembly 20. The outboard end of the outboard ramp 40 (when the ramp is in a deployed position) has a tapered nose portion 48 that provides a smooth transition between the panel 41 and the curb or sidewalk when the ramp assembly 20 is in a deployed position.

The moving floor 50 includes an outboard panel 70 hingedly coupled to an inboard panel 60 along a first hinge axis 31. The outboard end of the outboard panel 70, and thus the moving floor 40, is hingedly coupled to the inboard end (when the ramp is in a deployed position) of the outboard ramp 40 by a second hinge axis 33.

When the outboard ramp 40 is in the stowed position, the moving floor 50 is disposed within the frame 30 and positioned below the outboard ramp 40. In an exemplary embodiment shown in FIGS. 4-16, when the ramp assembly 20 is in the stowed position, the outboard panel 70 and the inboard panel 60 are positioned so that the upper surfaces of the panels 60 and 70 are generally coplanar and in a substantially horizontal position. It should be appreciated that the orientation of the inboard panel 60 and the outboard panel 70 relative to each other and to the frame of the ramp assembly 20 when the ramp assembly 20 is in the stowed position may vary without departing from the scope of the disclosure.

As the outboard ramp 40 moves from the stowed position to a deployed position, the outboard end of the outboard panel 70 moves to a lowered position and the inboard end of the outboard panel 70 moves to a raised position. The outboard end of the inboard panel 60 moves to a raised position in conjunction with the inboard end of the outboard panel 70 due to the hinged attachment therebetween. At the same time, the inboard end of the inboard panel 60 also moves to a raised position so that the inboard panel 60 is substantially horizontal and coplanar with the floor of the vehicle when the outboard ramp 40 is in a deployed position.

As a result of the above-described motion, when the ramp assembly 20 is in a deployed position, the outboard panel 70 extends from the outboard end of the inboard panel 60 in an outboard and downward direction to the inboard end of the outboard ramp 40. In this position, the outboard panel 70 has a slope approximately equal to the slope of the deployed outboard ramp 40, although some differences may occur due to from variation in the distance between the floor of the vehicle and the curb or street surfaces. Consequently, the outboard panel 70 effectively increases the overall length of the sloped portion of the deployed ramp assembly 20, thereby providing a more gradual slope without increasing the length of the outboard ramp 40. Because the length of the outboard ramp 40 is not increased, the torque required from the drive motor 92 to reciprocate the outboard ramp 40 between the stowed position and a deployed position is reduced.

The drive assembly 90 actuates the outboard ramp 40 to reciprocate between the stowed position and a deployed position. A forward portion of the drive assembly is located on the forward side of the frame 30. A rear portion of the drive assembly 90 is similarly located on the rear side of the frame 30, wherein each element of the forward portion of the drive assembly 90 corresponds to a similar element of the rear portion of the drive assembly 90. For the sake of clarity, the forward portion of the drive assembly 90 is described herein with the understanding that unless otherwise indicated, each element of the forward portion has a corresponding element on the rear portion of the drive assembly 90.

Figure 3:
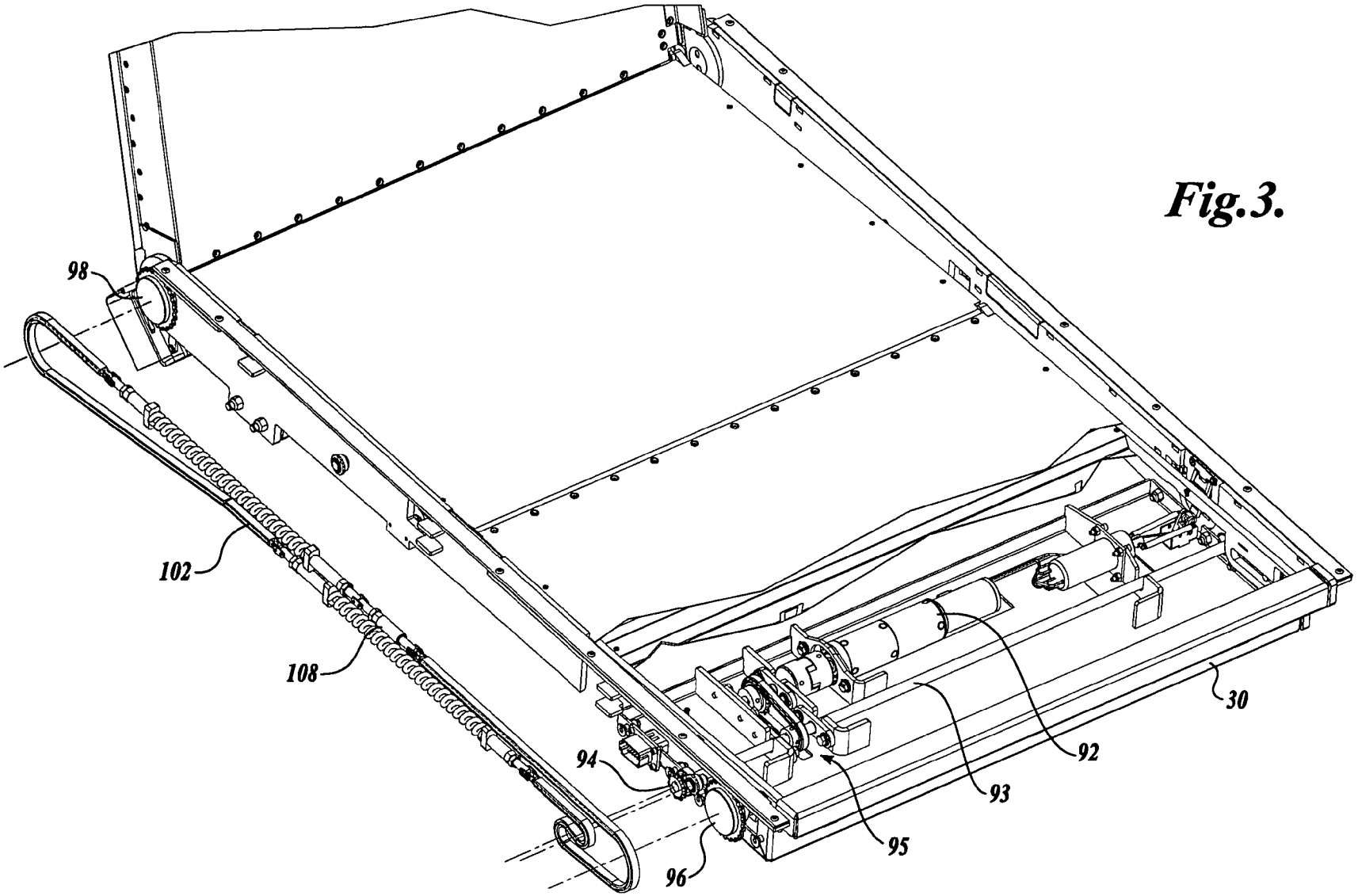
FIG. 3 is an isometric, partial cut-away view of the ramp assembly shown in FIG. 1, with the outboard ramp in a position between the stowed position and a deployed position
Figure 4:
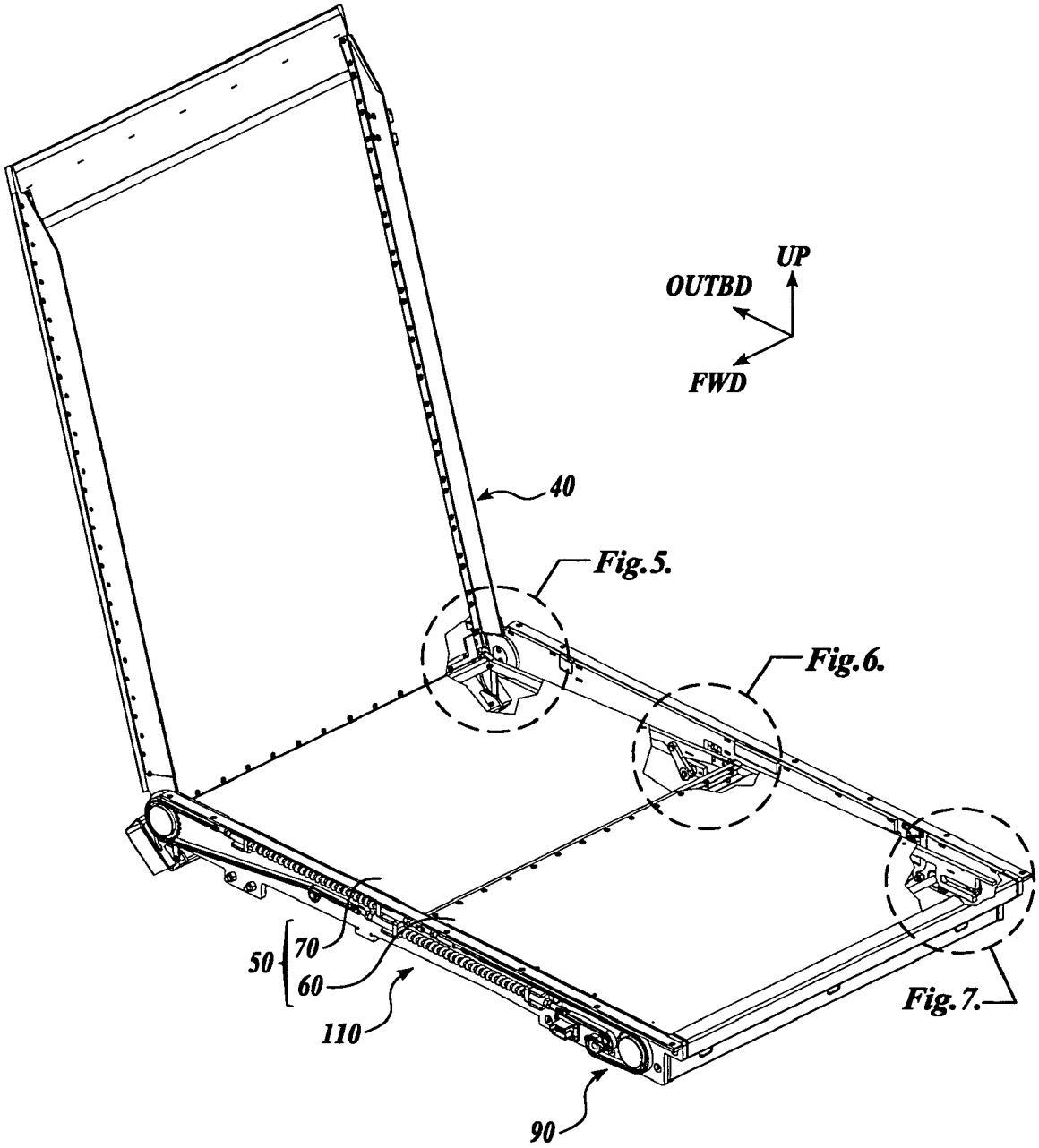
FIG. 4 is an isometric, partial cut-away view of the ramp assembly shown in FIG. 1, with the outboard ramp in a position between the stowed position and a deployed position.

Referring to the embodiment shown in FIGS. 1-3, the drive assembly 90 includes an inboard sprocket 96 that is rotatably coupled to the inboard end of the forward side of the frame 30 so that the axis of rotation of the inboard sprocket 96 extends in the forward/rearward direction. The drive assembly 90 also includes an outboard sprocket 98 that is rotatably coupled to the outboard end of the forward side of the frame 30 to have an axis of rotation that is substantially parallel to the axis of rotation of the inboard sprocket 96. A drive chain assembly 102 forms an endless loop that engages the teeth of the outboard sprocket 98 and the teeth of the inboard sprocket 96. As a result, movement of the drive chain assembly 102 along the path of the endless loop rotates the inboard sprocket 96 and the outboard sprocket 98.

The drive assembly 90 further includes drive sprocket 94 that is rotatably coupled to the forward side of the frame 30 intermediate to the inboard sprocket 96 and outboard sprocket 98. The drive sprocket 94 is oriented to have an axis of rotation substantially parallel to the axes of rotation of the inboard sprocket 96 and outboard sprocket 98. As shown in FIG. 3, a drive shaft 93 is coupled to the drive sprocket 94 to rotate the drive sprocket 94. The drive shaft 93 is also operatively coupled to a motor 92 by a well known transmission means 95. The motor 92 is selectively operated to rotate the drive sprocket 94, thereby driving the inboard sprocket 96 and the outboard sprocket 98 via the drive chain 102. In one embodiment, a single motor 92 drives the drive sprocket 94 of the forward portion of the drive assembly 90 and also the drive sprocket 94 of the rear portion of the drive assembly 90. In another embodiment, each drive sprocket 94 is driven by a separate motor 92.

One or more idler sprockets 100 may be included in the drive assembly 90. The optional idler sprockets 100 engage the drive chain 102 to redirect the drive chain 102 along a predetermined path. In one embodiment, the drive chain 102 includes a turnbuckle 108 that is selectively adjustable to increase or decrease the length of the drive chain 102 in order to adjust the tension of the drive chain 102.

Figure 5:
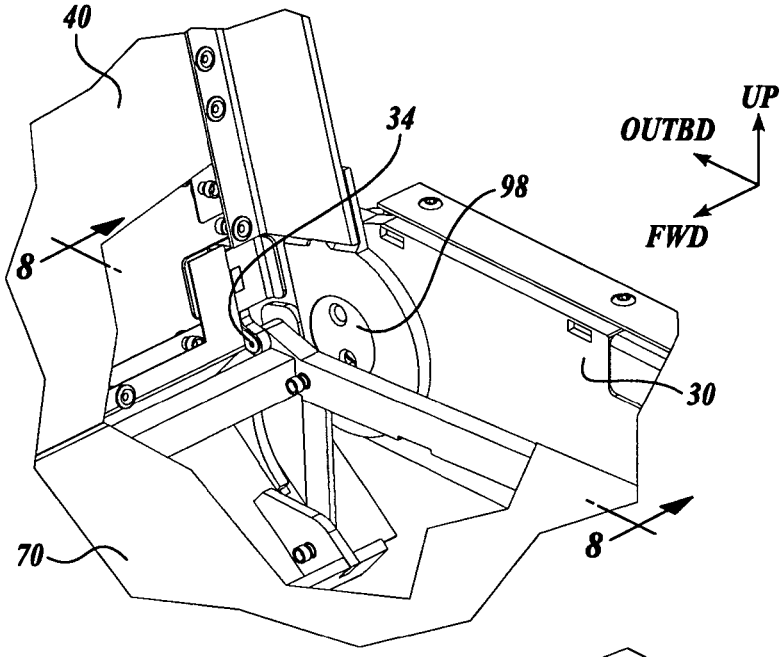
FIG. 5 is an isometric, partial cut-away view of a hinged connection between the outboard ramp and an outboard panel of the ramp assembly shown in FIG. 4.
Figure 6:
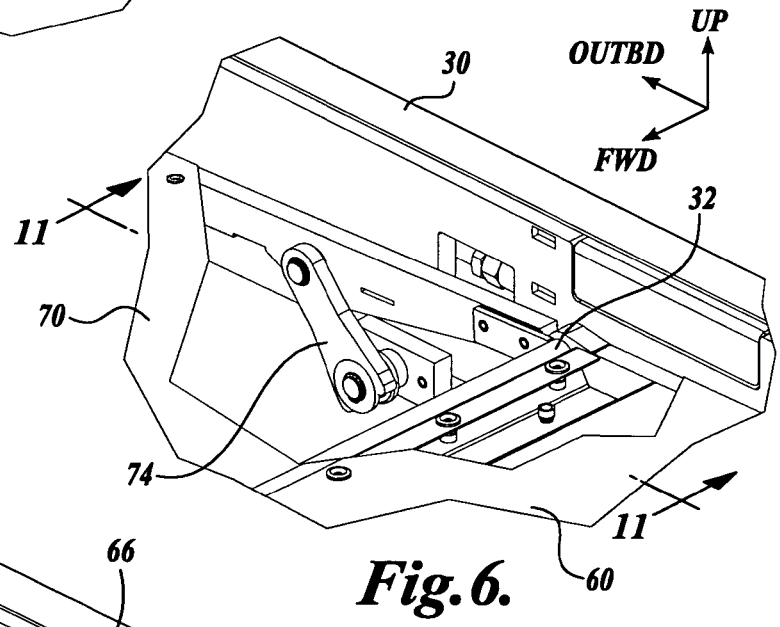
FIG. 6 is an isometric, partial cut-away view of an inboard support for the outboard panel of the ramp assembly shown in FIG. 4.
Figure 7:
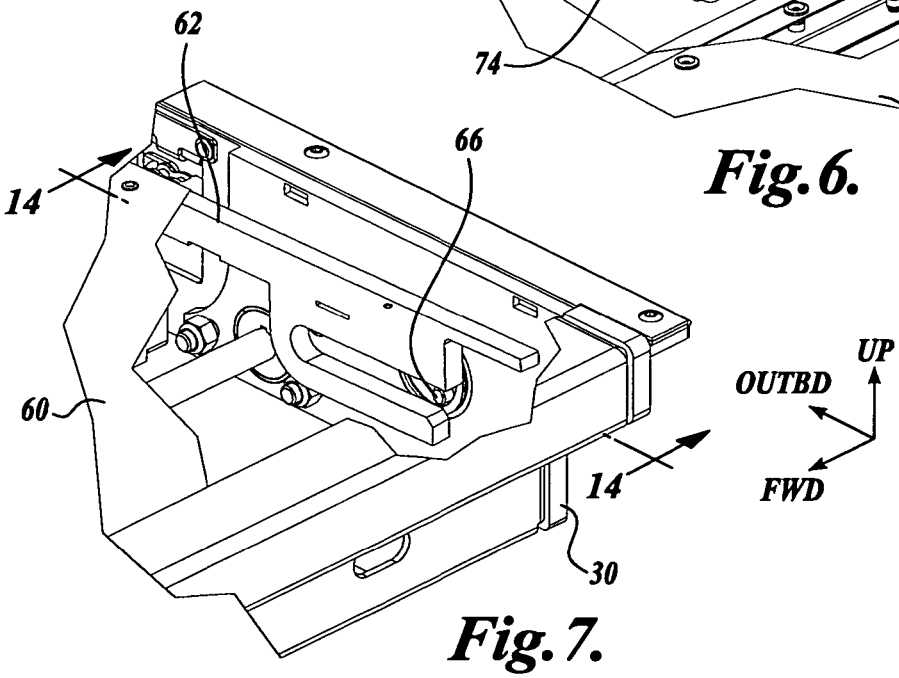
FIG. 7 is an isometric, partial cut-away view of an inboard support for an inboard panel of the ramp assembly shown in FIG. 4.

As illustrated in FIGS. 5 and 7, the inboard sprockets 96 and outboard sprockets 98 of the drive assembly 90 rotate cooperatively to reciprocate the ramp assembly 20 between the stowed position and a deployed position. More specifically, the outboard sprockets 98 rotate to reciprocate the outboard ramp 40 between the stowed position and a deployed position, while the inboard sprockets 96 and outboard sprockets 98 cooperate to raise and lower the moving floor 50.

Actuation of the Outboard Ramp

Figure 8:
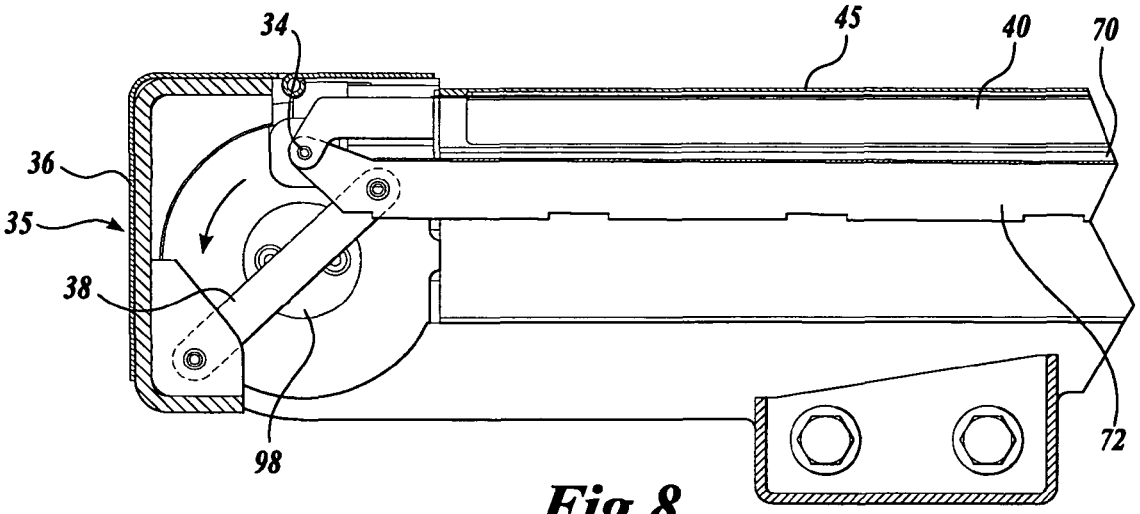
FIG. 8 is a partial cross-sectional side view of the hinged connection shown in FIG. 5, with the outboard ramp in the stowed position.
Figure 9:
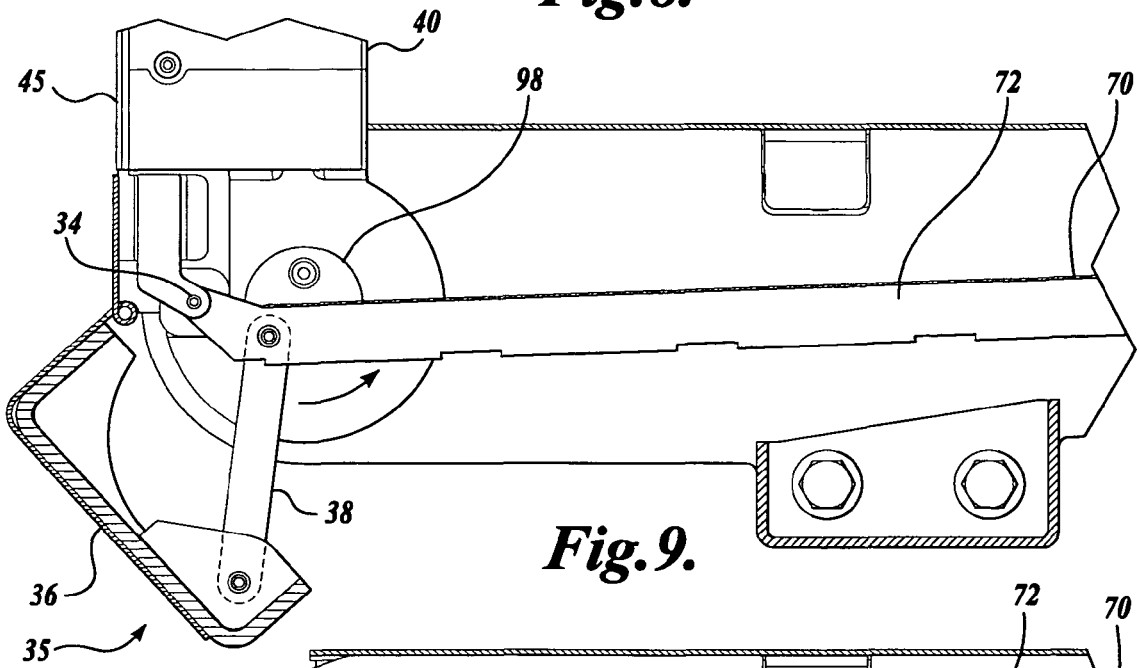
FIG. 9 is a partial cross-sectional side view of the hinged connection shown in FIG. 5, with the outboard ramp positioned between the stowed position and a deployed position.
Figure 10:
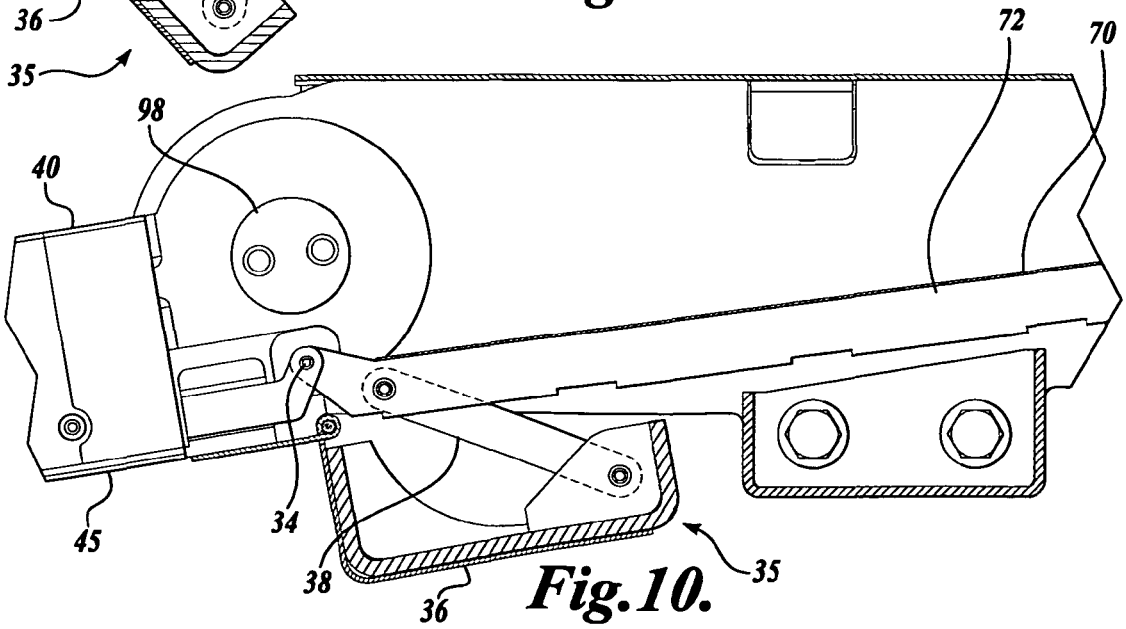
FIG. 10 is a partial cross-sectional side view of the hinged connection shown in FIG. 5, with the outboard ramp in a deployed position.

FIGS. 8-10 illustrate the outboard sprocket 98 as it actuates the outboard ramp 40 from the stowed position (FIG. 8), through an intermediate position (FIG. 9), to a deployed position (FIG. 10). A portion of the outboard sprocket 98 extends axially through the frame 30 into the interior portion of the frame 30. The outboard ramp 40 is fixedly attached to the portion of the outboard sprocket 98 that is disposed within the frame 30. The lower surface 45 of the outboard ramp 40, which faces upward when the ramp assembly 20 is in the stowed position, is offset from the axis of rotation of the outboard sprocket 98 so that the lower surface 45 is generally horizontal and coplanar with the floor of the vehicle when the ramp assembly 20 is in the stowed position.

To move the outboard ramp 40 from the stowed position to a deployed position, the outboard sprocket 98 is driven by the drive assembly 90 to rotate in a counterclockwise direction, as viewed in FIGS. 8-10. The outboard ramp 40 rotates with the outboard sprocket 98 until the tapered nose 48 of the outboard ramp 40 contacts a surface 22 of the road or sidewalk, at which point the outboard ramp 40 is in a deployed position.

Conversely, to move the outboard ramp 40 from a deployed position to the stowed position, the drive assembly 90 rotates the outboard sprocket 98 in a clockwise direction as viewed in FIGS. 8-10 (i.e., the direction opposite the arrows shown in FIGS. 8 and 9). The outboard ramp 40 rotates with the outboard sprocket 98 until the lower surface 45 of the outboard ramp 40 is generally horizontal and coplanar with the floor of the vehicle, at which point the outboard ramp 40 is in the stowed position. In the stowed position, the outboard ramp is supported at its edges by the frame 30 or the vehicle floor. By selectively operating the motor 92 of the drive assembly 90, the outboard ramp 40 is reciprocated between the stowed position and a deployed position.

Actuation of the Moving Floor i. Outboard Panel

As the outboard ramp 40 moves from the stowed position to the deployed position, the outboard panel 70 of the moving floor 50, which is made from known materials and includes side supports 72 at the forward and rear sides, moves from a substantially horizontal position within the frame 30 to a sloped position. When the outboard panel is so positioned, the outboard end of the outboard panel 70 is in a lowered position, and the inboard end of the outboard panel 70 is in a raised position.

a. Outboard End

As best shown in FIGS. 2 and 5, the outboard end of the outboard panel 70 is hingedly coupled to the inboard end of outboard ramp 40. In the illustrated embodiment, the hinge axis 33 includes hinge pins 34 located at the forward and rear sides of the outboard end of the outboard panel 70. The hinge pins 34 are positioned along a common hinge line, which is substantially parallel to, but offset from, the axis of rotation of the outboard sprockets 98.

As shown in FIG. 8, when the outboard ramp 40 is in the stowed position, each hinge pin 34 is located above the axis of rotation of the outboard sprocket 98, and the outboard end of the outboard panel 70 is in a raised position. Referring to FIGS. 9 and 10, as the outboard ramp 40 is deployed, the hinge pin 34, and thus the outboard end of the outboard panel 70, travels in a counterclockwise direction until the outboard ramp 40 is in a deployed position. When the outboard ramp 40 is in a deployed position, the hinge pin 34 is located below the axis of rotation of the outboard sprocket 98, and the outboard end of the outboard panel 70 is in a lowered position. When the outboard ramp 40 is moved from a deployed position to the stowed position, the hinge pin 34 moves in a clockwise direction as viewed in FIGS. 8-10, and the outboard end of the outboard panel 70 moves to a raised position.

b. Inboard End

Figure 11:
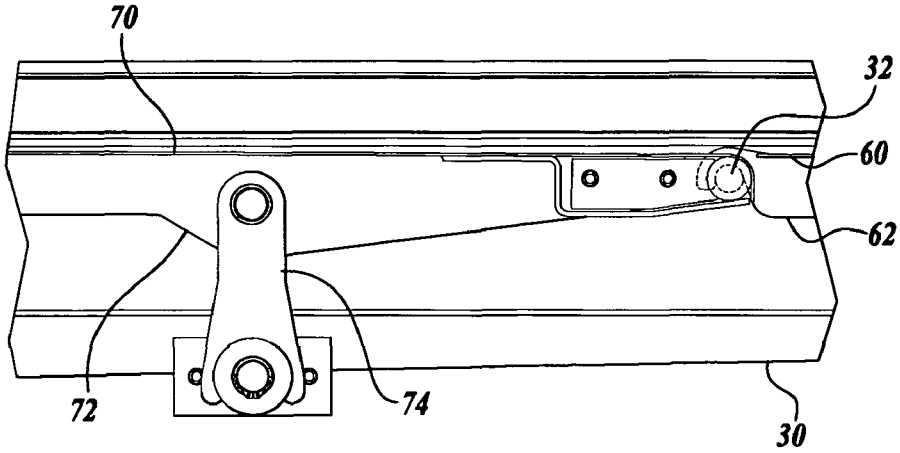
FIG. 11 is a partial cross-sectional side view of the inboard support for the outboard panel shown in FIG. 6, with the outboard ramp in the stowed position.
Figure 12:
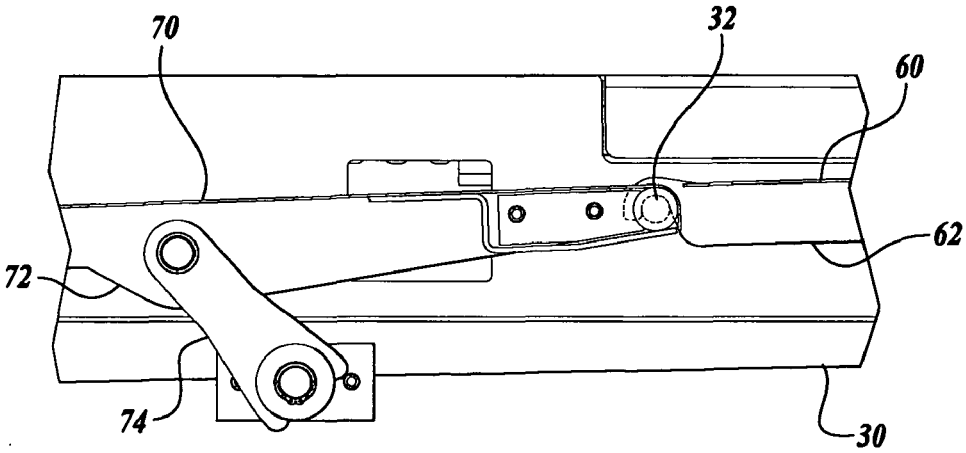
FIG. 12 is a partial cross-sectional side view of the inboard support for the outboard panel shown in FIG. 6, with the outboard ramp positioned between the stowed position and a deployed position.
Figure 13:
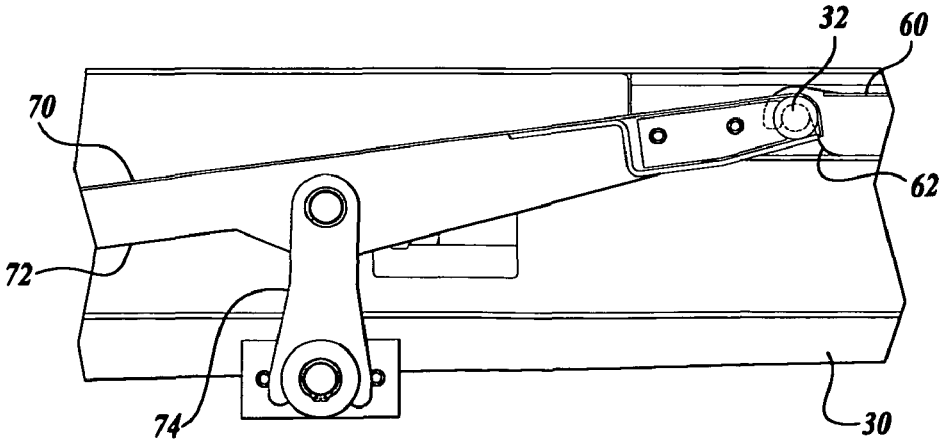
FIG. 13 is a partial cross-sectional side view of the inboard support for the outboard panel shown in FIG. 6, with the outboard ramp in a deployed position.

The inboard end of the outboard panel 70 is supported by a link 74 at each of the forward and rear sides. The link 74 that supports the rear side of the outboard panel 70 is shown in FIG. 11-13 and described herein with the understanding that a similar link 74 supports the forward side of the outboard panel 70. In alternate embodiments, a single link 74 supports the inboard end of the outboard panel 70 at either the forward or read side, or at a point between the forward and rear sides.

The link 74 is rotatably coupled at one end to a side support 72 of the outboard panel 70 and rotatably supported at the other end by the frame 30. In the embodiment shown in FIG. 11, when the outboard ramp 40 is in the stowed position, the link is in a generally vertical position. Referring to FIGS. 12 and 13, when the outboard ramp 40 moves from the stowed position to a deployed position, the link 74 rotates in a counter-clockwise direction about the pivotal connection to the frame 30 and then back to a generally vertical position in response to the arcuate motion of the outboard end of the outboard panel 70.

As the outboard ramp 40 moves from the stowed position to a deployed position, the movement of the outboard end of the outboard panel 70 from a raised position to a lowered position causes the outboard panel 70 to rotate about its rotational connection to the link 74 so that the outboard panel 70 is repositioned to have a downward slope in the outboard direction. The rotation of the outboard panel 70 about its rotational connection to the link 74 also causes the inboard end of the outboard panel 70, which extends inboard beyond the rotational connection to the link 74, to move up so that the inboard end is at or near the surface of the vehicle floor when the outboard ramp 40 is in a deployed position. When the outboard ramp 40 moves from a deployed position to the stowed position, the rotation of the outboard panel 70 is reversed, and the inboard end of the outboard panel 70 moves from a raised position at or near the surface of the vehicle floor to a lowered position within the frame 30.

When the outboard ramp 40 is in a deployed position, the outboard panel 70 has a slope approximately equal to the slope of the deployed outboard ramp 40 so that the outboard panel 70 is substantially parallel to the outboard ramp 40. Because the ramp is capable of providing a transition to surfaces having different heights, e.g., a curb, a street surface, a driveway, etc., the amount that the outboard ramp 40 rotates to a deployed position will vary. Accordingly, while the outboard panel 70 is substantially parallel to the outboard ramp 40, the angle between the outboard panel 70 and the outboard ramp 40 may be up to 20 degrees or more.

The slope is defined as the ratio of the height (rise) of a sloped portion to the horizontal length (run) of that sloped portion. To provide a slope that is gradual enough to allow safe ingress to and egress from the vehicle by a person in a wheelchair, the ratio of rise to run is generally no greater than 1:4. Smaller ratios, such as 1:5, 1:6, and 1:7 are preferable from a safety standpoint, but given vehicle floor height constraints, smaller ratios generally require longer ramps that result in larger actuation motors and more space required within the vehicle to stow the ramps. Although embodiments are not limited to any particular ratio, a ratio of 1:6 has been found to provide a balance between the increased safety of a more gradual slope and the design constraints inherent in a longer ramp.

ii. Inboard Panel

As the outboard ramp 40 moves from a stowed position to a deployed position, the inboard panel 60 moves from a lowered, generally horizontal position within the frame 30 to a raised position wherein the upper surface of the inboard panel 60 is substantially coplanar with the vehicle floor.

Figure 14:
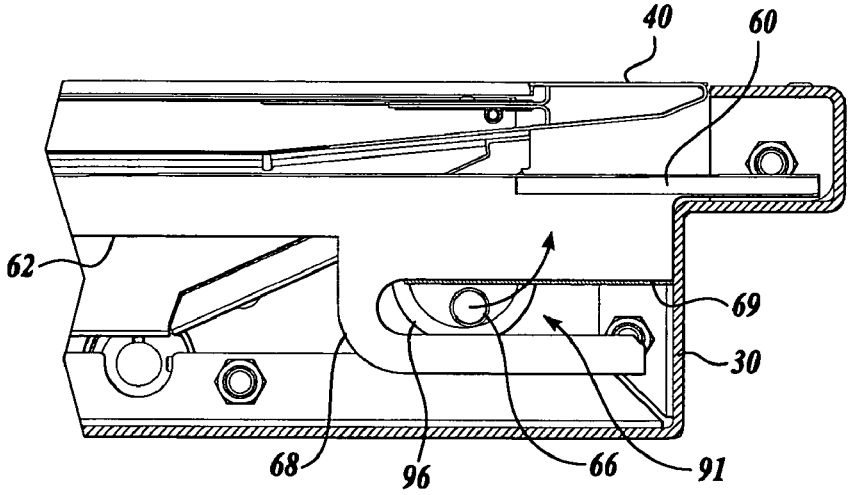
FIG. 14 is a partial cross-sectional side view of the inboard support for the inboard panel shown in FIG. 7, with the outboard ramp in the stowed position.
Figure 15:
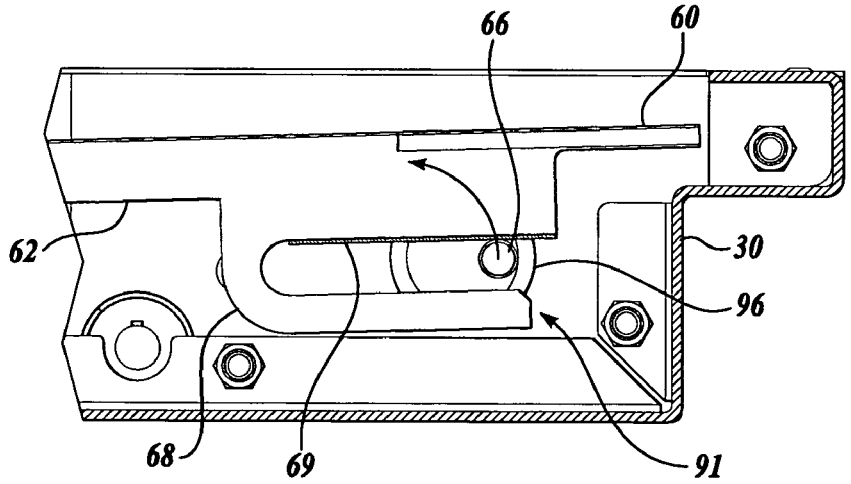
FIG. 15 is a partial cross-sectional side view of the inboard support for the inboard panel shown in FIG. 7, with the outboard ramp positioned between the stowed position and a deployed position.
Figure 16:
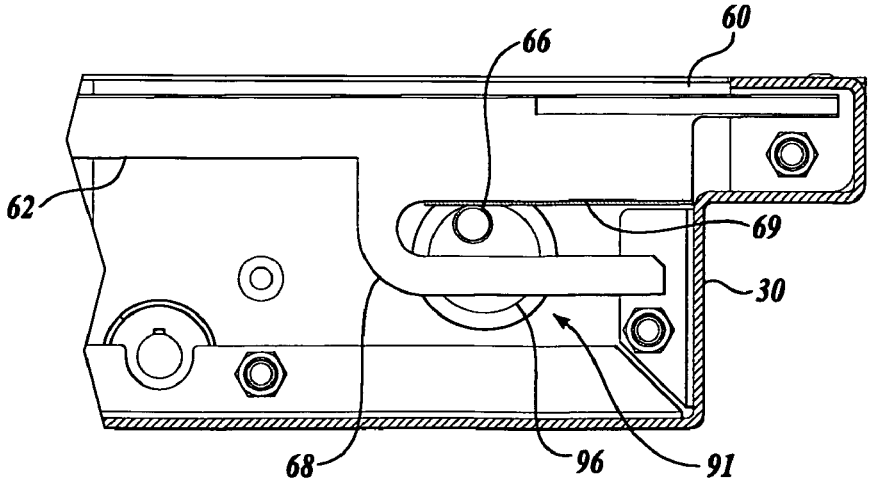
FIG. 16 is a partial cross-sectional side view of the inboard support for the inboard panel shown in FIG. 7, with the outboard ramp in a deployed position.

The inboard panel 60 is made from known materials and includes a side support 62 at each of the forward and rear sides. Referring to FIGS. 11-16, each side support 62 extends along the lower edge of the inboard panel 60 from the inboard end to the outboard end. As best shown in FIGS. 14-16, the side support 62 includes a protrusion that extends from the inboard portion of the side support 62 in an inboard and downward direction to form a C-shaped catcher 68. The catcher 68 opens toward the inboard end of the ramp assembly 20. A lower surface of the side support 62 that is located inboard of the catcher 68 optionally includes a bearing surface 69.

a. Outboard End

As shown in FIGS. 11-13, the outboard end of the inboard panel 60 is hingedly coupled to the inboard end of the outboard panel 70 at a hinge axis 31. In the illustrated embodiment, the hinge axis 31 includes a hinge pin 32 oriented substantially parallel to the axis of rotation of the inboard sprocket 96, and attached to the forward and rear sides of the inboard end of the outboard panel 70. The outboard end of the inboard panel 60 is rotatably coupled to the hinge pin 32. When the inboard end of the outboard panel 70 is raised to a position at or near the surface of the vehicle floor, the outboard end of the inboard panel 60 is also raised to a position at or near the surface of the vehicle floor due to the hinged connection.

b. Inboard End

FIGS. 14-16 show a reciprocating mechanism 91 that moves the inboard end of the inboard panel 60 moving from a lowered position to a raised position as the outboard ramp 40 moves from the stowed position (FIG. 14), through an intermediate position (FIG. 15), to a deployed position (FIG. 16). Similar to the outboard sprocket 98, a portion of the inboard sprocket 96 extends axially through the frame 30 into the interior portion of the frame 30. Referring to FIG. 14, the reciprocating mechanism 91 includes a pin 66 (support member), which is located within the frame 30 and is coupled to the inboard sprocket 96 so that the axis of rotation of the pin 66 is approximately parallel to the axis of rotation of the inboard sprocket 96. As the drive assembly 90 drives the inboard sprocket 96, the pin 66 travels in an arcuate path around the axis of rotation of the inboard sprocket 96.

As shown in FIG. 14, when the outboard ramp 40 is in the stowed position, the pin 66 is positioned below the axis of rotation of the inboard sprocket 96 and within the interior portion of the C-shaped catcher 68. In the disclosed embodiment, when the outboard ramp 40 is in the stowed position, the inboard end of the inboard panel 60 is supported by the frame 30, and the pin 66 does not engage the C-shaped catcher 68. In an alternate embodiment, the inboard end of the inboard panel 60 is supported by the pin 66 when the outboard ramp 40 is in the stowed position.

Referring to FIG. 15, when the outboard ramp 40 moves from the stowed position to a deployed position, the inboard sprocket 96 rotates in a counterclockwise direction. As the pin 66 travels along an arcuate path as a result of the motion of the inboard sprocket 96, the pin 66 moves in an upward direction to engage a lower surface of the C-shaped catcher 68. The pin 66 continues to move upward, providing continuous support to the inboard end of the inboard panel 60, thereby moving the inboard end of the inboard panel 60 from a lowered position to a raised position. A roller bearing may optionally be used instead of the pin 66 so that the roller bearing rollingly engages the lower surface of the C-shaped catcher 68.

FIG. 16 shows the inboard end of the inboard panel 60 when the outboard ramp 40 is in a deployed position. The pin 66 is generally positioned above the axis of rotation of the inboard sprocket 96 and is disposed within the catcher 68. The pin 66 supports the inboard end of the inboard panel 60 so that the upper surface of the inboard panel 60 is coplanar with or substantially parallel to the floor of the vehicle. In this regard, variation between the inboard panel 60 and the vehicle floor may include an offset of up to one inch or more. Further, although the inboard panel 60 is substantially parallel to the vehicle floor, angular differences in the range of 0 to 20 degrees are possible and should be considered within the scope of the disclosed subject matter. If external forces tend to raise the inboard end of the inboard panel 60, the pin 66 engages the catcher 68, thereby preventing the inboard end of the inboard panel 60 from moving in an upward direction.

When the outboard ramp 40 is moved from a deployed position to the stowed position, the inboard sprocket 96 rotates in a clockwise direction as viewed in FIGS. 14-16 (i.e., the direction opposite the arrows shown in FIGS. 14 and 15), and the pin 66 travels in a downward arcuate path. The inboard end of the inboard panel 60, which is supported by the pin 66, travels downward with the pin 66 until the outboard ramp 40 is in the stowed position. When the outboard ramp 40 is in the stowed position, the inboard end of the inboard panel 60 is disposed within the frame 30 in a lowered position.

Closeout Assembly

As shown in FIGS. 8-10, a closeout assembly 35 includes an end cap 36 with an upper end pivotally connected to the outboard end (when the ramp 40 is in a stowed position) of the outboard ramp 40 so that the pivot location is generally above the outboard sprocket 98. The end cap 36 extends in a forward and rear direction to cover the outboard end of the frame 30 when the outboard ramp 40 is in the stowed position. The end cap 36 reduces the amount of dirt and debris that can make its way into the interior portion of the frame 30, thereby reducing wear of the ramp assembly 20 components The end cap 36 also provides a step edge and cover when the outboard ramp 40 is in the stowed position, and people enter and exit the vehicle on foot.

The closeout assembly 35 further includes a link 38 pivotally coupled to the lower end of the end cap 36 with a pinned connection. The other end of the link 38 is pivotally coupled to the moving floor 50 by a second pinned connection. As the outboard ramp 40 moves between the stowed position and a deployed position, the upper end of the end cap 36 moves in an arcuate path with the outboard sprocket 98. At the same time, the lower end of the end cap 36 is driven by the link 38 to a location under and inboard of the outboard sprocket 98. When the outboard ramp 40 moves from the stowed position to a deployed position, the end cap 36 moves from a closed position around the axis of the outboard sprocket 98 and out of the path of the outboard ramp 40 to an open position beneath the moving floor 50.

Counterbalance Assembly

Figure 17:
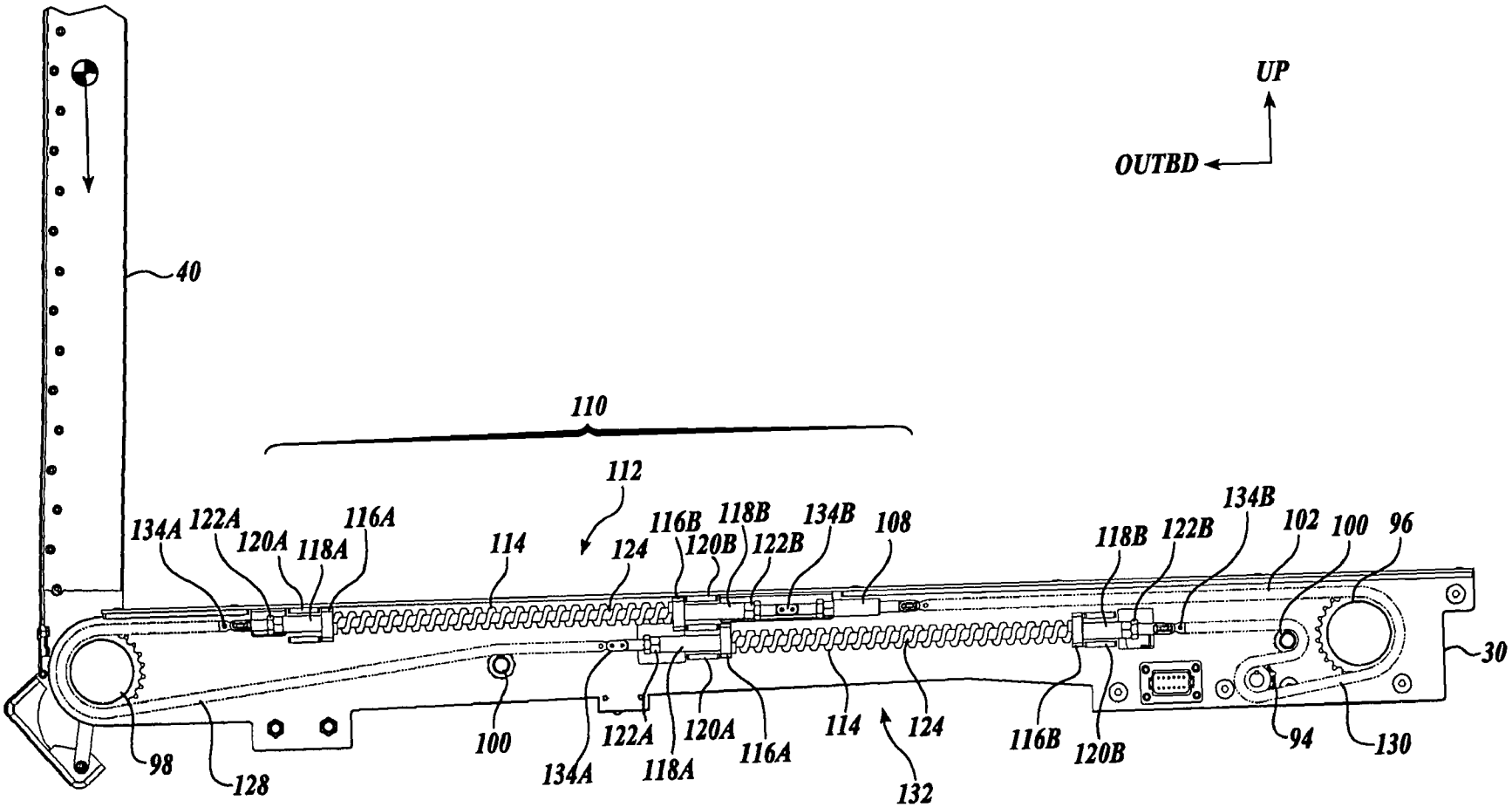
FIG. 17 is a partial side view of the ramp assembly shown in FIG. 1, with the outboard ramp in a neutral position.

FIG. 17 illustrates the ramp assembly 20 positioned between the stowed position and a deployed position so that the outboard ramp 40 forms an angle of approximately 90° with the frame 30. The center of gravity (CG) of the outboard ramp 40 is located approximately over the axis of rotation of the outboard sprocket 98. In this "neutral" position, the CG of the outboard ramp 40 does not impart a moment M about the axis of rotation of the outboard sprocket 98.

Figure 18:
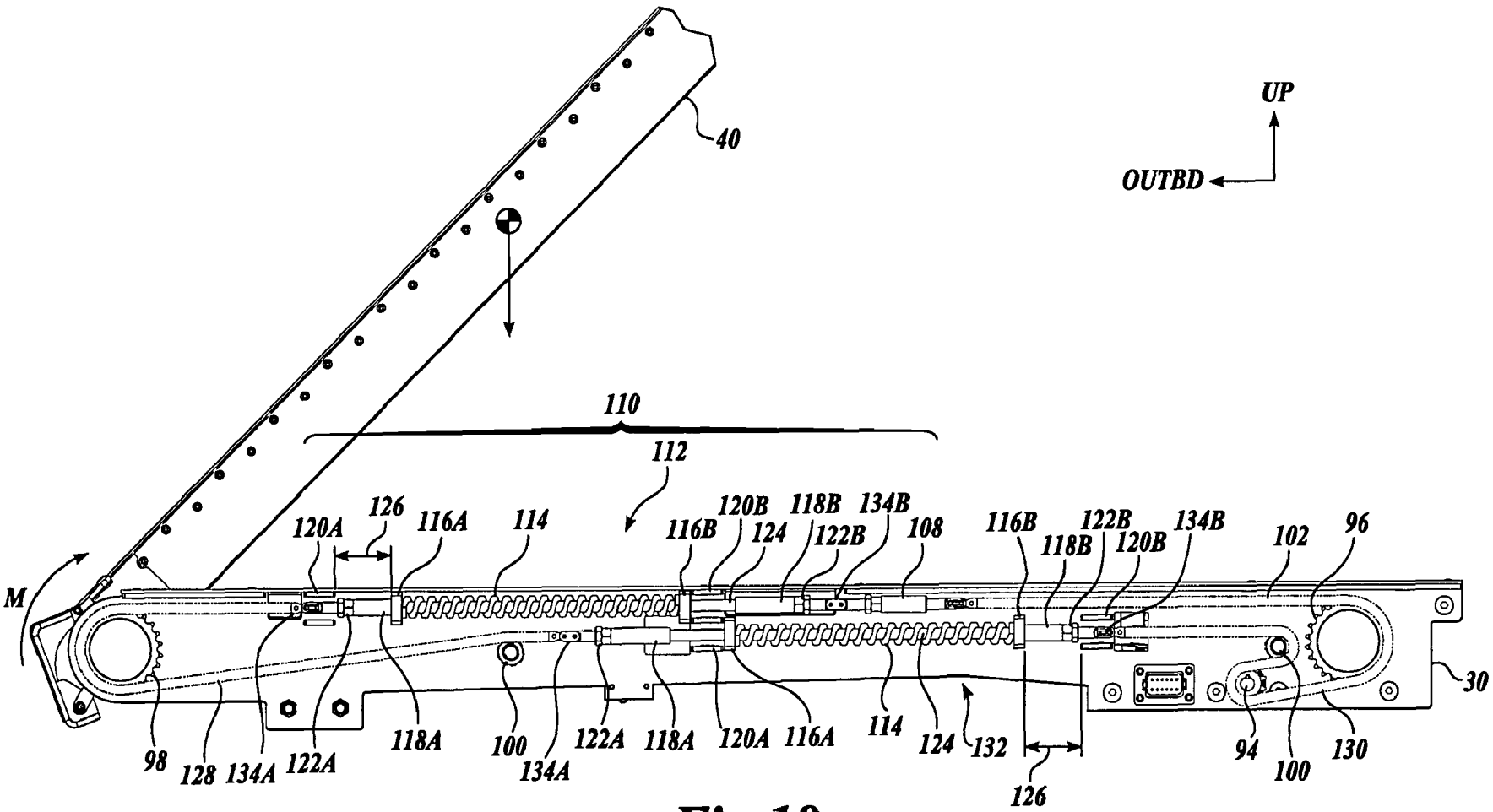
FIG. 18 is a partial side view of the ramp assembly shown in FIG. 1, with the outboard ramp positioned between a neutral position and the stowed position.

FIG. 18 shows the outboard ramp 40 at a position between the neutral position and the stowed position. When the outboard ramp is so positioned, the CG of the outboard ramp 40 is located inboard of the axis of rotation of the outboard sprocket 98. Accordingly, the CG of the outboard ramp 40 imparts moment M about the axis of rotation of the outboard sprocket 98, wherein the moment M tends to move the outboard ramp 40 toward the stowed position.

Figure 19:
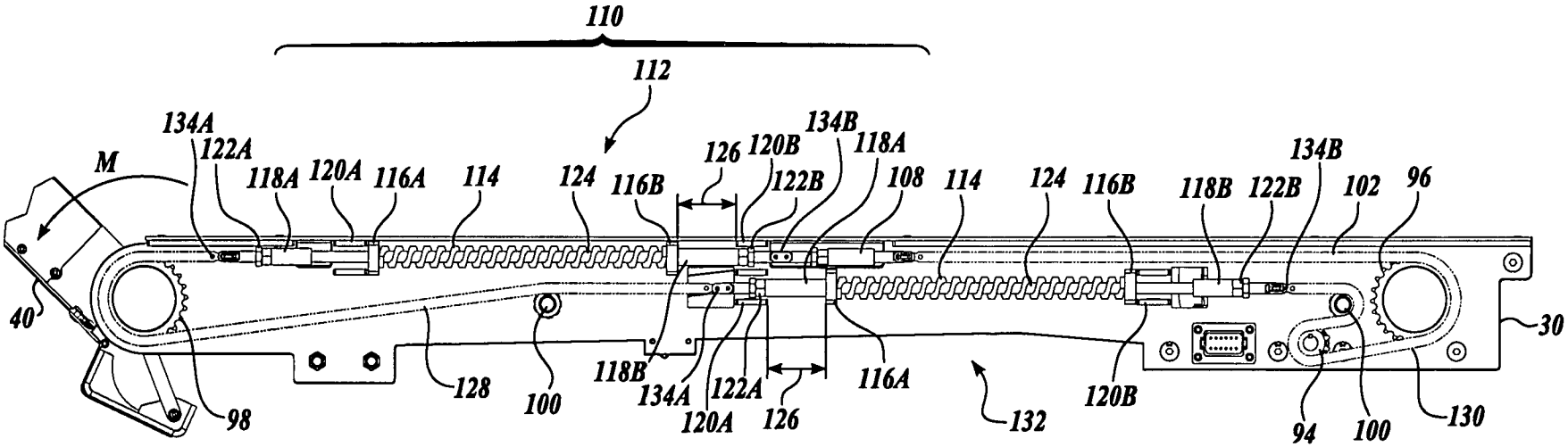
FIG. 19 is a partial side view of the ramp assembly shown in FIG. 1, with the outboard ramp positioned between a neutral position and a deployed position.

FIG. 19 shows the outboard ramp 40 at a position between the neutral position and a deployed position. In this position, the CG of the outboard ramp 40 is located outboard of the axis of rotation of the outboard sprocket 98. As a result, the CG of the outboard ramp 40 imparts moment M about the axis of rotation of the outboard sprocket 98, wherein the moment M tends to move the outboard ramp 40 toward a deployed position.

Although the neutral position is illustrated as a position wherein the outboard ramp 40 is positioned at an angle of approximately 90° from the frame 30, it should be understood that the position of the CG of the outboard ramp 40 can vary, resulting in a neutral position wherein the angle of the outboard ramp to the frame 30 is greater than or less than 90°.

As shown in FIGS. 17-19, the ramp assembly 20 may include a counterbalance assembly 110 to counteract the moment M imparted about the axis of rotation of the outboard sprocket 98 by the CG of the outboard ramp 40. Because the moment M is reacted by the counterbalance assembly 110, the torque output required from the motor 92 of the drive assembly 90 is reduced. The reduced torque requirement allows for the use of a smaller motor 92 and also reduces wear on the motor 92.

The counterbalance assembly 110 includes an upper spring assembly 112 and a lower spring assembly 132 on each of the forward and rear sides of the ramp assembly 20, for a total of four spring assemblies. For the sake of clarity, the upper and lower spring assemblies 112, 132 located on the forward side of the ramp assembly 20 are described with the understanding that similar upper and lower spring assemblies 112, 132 are located on the rear side of the ramp assembly 20.

Referring to FIG. 17, the upper and lower spring assemblies 112, 132 are attached in series to segments of the drive chain 102. More specifically, the outboard end of the upper spring assembly 112 is coupled to the upper end of an outboard chain segment 128, and the inboard end of the upper spring assembly 112 is coupled to the upper end of an inboard chain segment 130. The outboard end of the lower spring assembly 132 is coupled to the lower end of the outboard chain segment 128, and the inboard end of the lower spring assembly 132 is coupled to the lower end of the inboard chain segment 130. In this manner, a drive chain 102 forms an endless loop, wherein the loop comprises the following components in order: outboard chain segment 128, upper spring assembly 112, inboard chain segment 130, and lower spring assembly 132.

The lower spring assembly 132 includes a rigid rod 124 positioned in an inboard/outboard orientation. The outboard end of the rod 124 is coupled to the lower end of the outboard chain segment 128 with a pinned connection at 134A. Similarly, the inboard end of the rod 124 is coupled to the lower end of the inboard chain segment 130 with a pinned connection at 134B. A helical compression spring 114 is concentrically arranged with respect to the rod 124 so that the rod 124 is disposed within the center of the coils of the spring 114.

Still referring to FIG. 17, the lower spring assembly 132 further includes a spring fitting 116A, a cylindrical bushing 118A, and an adjustment nut 122A associated with the outboard end region of the rigid rod 124. The spring fitting 116A has an aperture with a diameter larger than the outer diameter of the rod 124, but smaller than the outer diameter of the compression spring 114. The spring fitting 116A is coupled to the outboard end of the rod 124 so that the rod passes through the aperture of the spring fitting 116A. The cylindrical bushing 118A is slidingly coupled to the rod 124 so that a portion of the rod 124 is disposed within the bore of the bushing 118A. Thus, the outboard end of the compression spring 114 bears against the inboard surface the spring fitting 116A, and the outboard surface of the spring fitting 116A bears against the inboard surface of the cylindrical bushing 118A. The adjustment nut 122A threadedly engages a threaded portion of the outboard end of the rod 124. The inboard end of the adjustment nut 122A engages the outboard end of the cylindrical bushing 118A, preventing the cylindrical bushing 118A, the spring fitting 116A, and the outboard end of the compression spring 114 from moving in an outboard direction relative to the rod 124.

Similar to the outboard end of the rod 124, a spring fitting 116B, a bushing 118B, and an adjustment nut 122B are attached to the inboard end of the rod 124. That is, the spring fitting 116B is installed inboard of the compression spring 114, the bushing 118B is installed inboard of the spring fitting 116B, and the adjustment nut 122B installed inboard of the bushing 118B.

Still referring to FIG. 17, the compression spring 114 of the described lower spring assembly 132 is compressed between the two spring fittings 116A-B. The combination of the spring fittings 116A-B, bushings 118A-B, and nuts 122A-B prevents the compressed spring from expanding in either the inboard or outboard direction. Further, the preload on the compressed spring 114 can be adjusted by selectively adjusting the distance between the adjustment nuts 122A-B. As the distance between the nuts 122A-B is decreased, the spring 114 is further compressed, increasing the preload on the spring 114. Conversely, if the distance between the nuts 122A-B is increased, the spring 114 expands, and the preload on the spring 114 is decreased.

The compression spring 114 and spring fittings 116A-B are disposed between inboard and outboard end stops 120A-B. Each C-shaped end stop 120A-B includes a channel positioned in the direction of the compression spring and sized to allow the bushings 118A-B and adjustment nuts 122A-B to pass therethrough. The spring fittings 116A-B, however, are sized so as not to pass through the channels, but instead remain disposed between the inboard and outboard end stops 120A-B.

The upper spring assembly 112 is similar to the lower spring assembly 132 with one exception. In the illustrated embodiment shown in FIGS. 17-19, the inboard end of the upper rod 124 is coupled to one end of a turnbuckle 108. The other end of the turnbuckle 108 is coupled to the upper end of the inboard chain segment 130. The tension of the drive chain 102 is selectively adjustable by rotating the turnbuckle 108. Although the turnbuckle 108 is illustrated attached to the inboard end of the upper spring assembly 112, it should be understood that the turnbuckle can be located at any position along the path of the drive chain 102 that does not interfere with the spring assemblies 112, 132 or the sprockets of the drive assembly 90.

FIG. 18 shows the ramp assembly 20 with the outboard ramp 40 located between a neutral position and the stowed position. As the outboard ramp 40 moves toward the stowed position, the CG of the outboard ramp moves inboard, imparting a moment M that tends to move the outboard ramp 40 into the stowed position. Moreover, as the outboard ramp 40 moves further towards the stowed position, the horizontal distance between the axis of rotation of the outboard ramp 40 and the CG of the outboard ramp 40 increases, thus increasing the magnitude of the moment M on the outboard sprocket 98.

The moment M imparted by the CG of the outboard ramp 40 is counteracted by biasing forces that result from the compression of the springs 114 of the upper and lower spring assemblies 112, 132. Referring to FIG. 18, as the outboard ramp 40 moves toward the stowed position, the drive chain 102 moves in a clockwise direction along its path. With regard to the upper spring assembly 112, the clockwise motion of the drive chain 102 drives the outboard adjustment nut 122A, which is threadedly secured to the rod 124, in an inboard direction. As the nut 122A moves inboard, it drives the bushing 118A and the spring fitting 116A inboard, creating a gap 126 between the outboard end of the spring fitting 116A and the inboard end of the end stop 120A. The inboard end of the spring fitting 116A bears against the outboard end of the compression spring 114 so that the outboard end of the compression spring 114 moves inboard with the spring fitting 116A. At the inboard end of the upper spring assembly 112, the bushing 118B and the adjustment nut 122B move inboard with the drive chain 102 and the rod 124. The spring fitting 116B, and therefore the inboard end of the compression spring 114, are prevented from moving inboard by the inboard end stop 120B.

As described above, movement of the outboard ramp 40 from a neutral position to the stowed position causes the outboard end of the upper compression spring 114 to move inboard, while the inboard end remains fixed against the inboard end stop 120B. The resulting compression of the spring 114 creates a biasing force that resists the moment M that results from the CG of the outboard ramp 40. The biasing force is approximately proportional to the amount by which the spring 114 is compressed, i.e., the spring is a linear spring. That is, greater spring compression results in a greater biasing force. As previously noted, the moment M increases as the outboard ramp 40 approaches the stowed position from a neutral position. Accordingly, both the moment M and the biasing force of the spring 114 increase as the outboard ramp 40 approaches the stowed position. The increase in the moment M is sinusoidal, and the increase in the biasing force of the spring 114 is linear. Thus, while the biasing force of the spring 114 does not increase in exact proportion to the increase in the moment M, the biasing force does increase in approximation to the increase of the moment M.

The springs 114 of the counterbalance assembly 110 are preferably selected to minimize the difference between the force supplied by the springs 114 and the force required to counteract the moment M as the outboard ramp 40 reciprocates between a stowed position and a deployed position. For linear springs, the spring stiffness can be selected such that differences due to the linear increase in spring resistance and the sinusoidal increase of the moment M are reduced. In other embodiments, non-linear springs are used so that the resistance supplied by the spring increases at a non-linear rate, allowing the spring resistance to match more closely the force required to resist the moment M as the outboard ramp 40 reciprocates between a stowed position and a deployed position. Non-linear springs are known in the art. For example, a spring formed with a variable coil pitch will exhibit non-linear properties. It should be understood that various known spring configurations providing linear or non-linear reactive force can be included in the counterbalance assembly 110 without departing from the spirit and scope of the present invention. In addition, alternate systems can be used to provide a resistive force, such as pneumatic systems, hydraulic systems, and other systems known in the art.

The lower spring assembly 132 functions in a manner similar to the upper spring assembly 112. As the outboard ramp 40 moves from a neutral position to the stowed position, the inboard spring fitting 116B moves outboard to compress the spring 114 against the outboard spring fitting 116A, which is prevented from moving in the outboard direction by the outboard end stop 120A. The compression of the spring 114 results in a biasing force that resists the moment M resulting from the CG of the outboard ramp 40.

The biasing forces produced by the upper and lower spring assemblies 112, 132 act on the drive chain 102 in a direction opposite to the moment M. As the moment M shown in FIG. 18 tends to move the drive chain 102 in a clockwise direction, the biasing forces produced by the upper and lower spring assemblies 112, 132 tend to move the drive chain in a counterclockwise direction. To the extent that the biasing forces counteract the moment M, the torque required from the motor 92 to drive the drive assembly 90 is reduced.

FIG. 19 illustrates the ramp assembly 20 with the outboard ramp 40 located between a neutral position and a deployed position. The CG (not shown) of the outboard ramp 40 is located outboard of the axis of rotation of the outboard ramp 40, creating a moment M that tends to move the outboard ramp 40 into the deployed position. The upper and lower spring assemblies are compressed in a similar fashion as discussed with respect to FIG. 18, but in an opposite direction. More specifically, as the moment M tends to move the drive chain 102 in a counterclockwise direction, the upper and lower spring assemblies 112, 132 provide biasing forces that tend to move the drive chain in a clockwise direction.

As previously noted, upper and lower spring assemblies 112, 132 are positioned on the forward and rear sides of the ramp assembly 20. The four spring assemblies cooperate to resist the moment M created when the ramp is not in a neutral position, with each spring assembly providing approximately one fourth of the total resistive force.

It should be appreciated that the number and location of the spring assemblies may vary without departing from the scope of the claimed subject matter. In one alternate embodiment, a single spring assembly is used. Further alternate embodiments may include springs having different stiffnesses.

While illustrative embodiments have been illustrated and described, it will be appreciated that various changes can be made therein without departing from the spirit and scope of the invention.

The embodiments of the invention in which an exclusive property or privilege is claimed are defined as follows:

1. A ramp assembly for a vehicle having a floor, the ramp assembly comprising:

(a) a ramp rotatably coupled within the vehicle;

(b) a moving floor, comprising:

(i) an outboard panel having an outboard end hingedly coupled to an inboard end of the ramp to define an outboard hinge line, the outboard hinge line moving between a raised position when the ramp is in a stowed position and a lowered position when the ramp is in a deployed position; and (ii) an inboard panel having an outboard end hingedly coupled to an inboard end of the outboard panel; and (c) a reciprocating mechanism to reciprocate an inboard end of the inboard panel between a lowered position when the ramp is in the stowed position, and a raised position when the ramp is in the deployed position.

2. The ramp assembly of claim 1, further comprising a support member for supporting an inboard portion of the outboard panel.

3. The ramp assembly of claim 2, wherein the support member comprises a link having a first end coupled to the outboard panel, and a second end engaging the vehicle.

4. The ramp assembly of claim 3, wherein the first end of the link reciprocates along an arcuate path as the ramp reciprocates between the stowed position and the deployed position.

5. The ramp assembly of claim 1, wherein the reciprocating mechanism comprises a support element coupled to the vehicle, the support element reciprocating between a lowered position when the ramp is in the stowed position, and a raised position when the ramp is in the deployed position.

6. The ramp assembly of claim 5, wherein the support element comprises a roller bearing for rollingly engaging a lower surface of the inboard panel.

7. The ramp assembly of claim 5, wherein the support element comprises a pin for slidingly engaging a lower surface of the inboard panel.

8. The ramp assembly of claim 1, wherein an upper surface of the inboard panel is substantially parallel to the floor of the vehicle when the ramp is in the deployed position.

9. The ramp assembly of claim 1, wherein a surface of the outboard panel is substantially parallel with a surface of the ramp when the ramp is in the deployed position.

10. The ramp assembly of claim 1, further comprising a drive assembly operably coupled to the ramp to reciprocate the ramp between the stowed position and the deployed position.

11. The ramp assembly of claim 1, wherein the drive assembly comprises:

(a) a motor; and (b) a drive chain assembly forming an endless loop, the drive chain assembly comprising a chain portion operatively coupled to an output shaft of the motor, wherein the drive chain assembly is operatively coupled to the ramp so that rotation of the output shaft reciprocates the ramp between the stowed position and the deployed position.

12. The ramp assembly of claim 11, wherein the drive chain assembly further comprises a counterbalance assembly, the counterbalance assembly comprising:

(a) a first spring for applying a biasing force to the chain portion in a first direction when the ramp is positioned between a neutral position and the deployed position; and (b) a second spring for applying a biasing force to the chain portion in a second direction opposite the first direction when the ramp is positioned between the neutral position and the stowed position.

13. The ramp assembly of claim 1, wherein the ramp has a slope of 1:6 or less when the ramp is in the deployed position.

14. The ramp assembly of claim 1, further comprising a closeout assembly, the closeout assembly comprising:

(a) an end cap hingedly coupled to the ramp; and (b) an actuating link having a first end coupled to the end cap, and a second end coupled to the outboard panel, wherein reciprocation of the ramp between the stowed position and the deployed position reciprocates the end cap between a closed position and an open position.

15. The ramp assembly of claim 14, wherein the closeout assembly provides a step surface and at least partially obscures an area between the ramp and the outboard panel when the ramp is in the stowed position.

16. A wheelchair ramp assembly for a vehicle having a floor, the wheelchair ramp comprising:

(a) a ramp coupled within the vehicle;

(b) an outboard panel having an outboard end hingedly coupled to the inboard end of the ramp to define a hinge line;

(c) an inboard panel having an outboard end hingedly coupled to an inboard end of the outboard panel;

(d) a reciprocating mechanism to reciprocate an inboard end of the inboard panel between a lowered position when the ramp is in the stowed position, and a raised position when the ramp is in a deployed position; and (e) a support member for supporting an inboard portion of the outboard panel.

17. The wheelchair ramp assembly of claim 16, further comprising a drive assembly coupled to the ramp to reciprocate the ramp between a stowed position and a deployed position.

18. The wheelchair ramp assembly of claim 16, wherein the hinge line is parallel to and offset from a center of rotation of the ramp.

19. The wheelchair ramp assembly of claim 16, wherein an upper surface of the inboard panel is substantially parallel to the floor of the vehicle when the ramp is in the deployed position.

20. The wheelchair ramp assembly of claim 16, wherein a surface of the outboard panel is substantially parallel with a surface of the ramp when the ramp is in the deployed position.

* * * * *